US007448150B1

(12) United States Patent
Davis et al.

(10) Patent No.: US 7,448,150 B1
(45) Date of Patent: Nov. 11, 2008

(54) INSERT WITH VARIABLE CUSHIONING AND SUPPORT AND ARTICLE OF FOOTWEAR CONTAINING SAME

(75) Inventors: Paul M. Davis, Blackstone, MA (US); Todd Ellis, Canton, MA (US)

(73) Assignee: Reebok International Ltd., Canton, MA (US)

( * ) Notice: Subject to any disclaimer, the term of this patent is extended or adjusted under 35 U.S.C. 154(b) by 88 days.

(21) Appl. No.: 11/068,057

(22) Filed: Feb. 28, 2005

Related U.S. Application Data

(60) Provisional application No. 60/547,536, filed on Feb. 26, 2004.

(51) Int. Cl.
*A43B 13/20* (2006.01)

(52) U.S. Cl. ..... 36/29; 36/35 B; 36/153

(58) Field of Classification Search ..... 36/29, 36/153, 154, 35 B
See application file for complete search history.

(56) References Cited

U.S. PATENT DOCUMENTS

| | | | |
|---|---|---|---|
| 410,622 | A | 9/1889 | Houck |
| 508,034 | A | 11/1893 | Moore |
| 510,504 | A | 12/1893 | Foster |
| 545,705 | A | 9/1895 | MacDonald |
| 547,645 | A | 10/1895 | LaCroix |
| 566,422 | A | 8/1896 | Singleton |
| 580,501 | A | 4/1897 | Moberley |
| 586,155 | A | 7/1897 | Bascom |
| 836,364 | A | 11/1906 | Busby |
| 850,327 | A | 4/1907 | Tauber |
| 900,867 | A | 10/1908 | Miller |
| 1,069,001 | A | 7/1913 | Guy |
| 1,145,534 | A | 7/1915 | Wetmore |
| 1,148,376 | A | 7/1915 | Gay |
| 1,193,608 | A | 8/1916 | Poulson |
| 1,241,832 | A | 10/1917 | Drunkenmiller |
| 1,304,915 | A | 5/1919 | Spinney |
| 1,328,154 | A | 1/1920 | Jackerson |
| 1,383,067 | A | 6/1921 | Borman |
| 1,498,838 | A | 6/1924 | Harrison, Jr. |
| 1,605,985 | A | 11/1926 | Rasmussen |

(Continued)

FOREIGN PATENT DOCUMENTS

| | | |
|---|---|---|
| BR | 8305004 | 4/1985 |

(Continued)

OTHER PUBLICATIONS

Zonic Product Brochure, date unknown.

(Continued)

*Primary Examiner*—Ted Kavanaugh
(74) *Attorney, Agent, or Firm*—Sterne, Kessler, Goldstein & Fox P.L.L.C.

(57) ABSTRACT

The invention is a support and cushioning system for an article of footwear. The system includes a resilient insert disposed within the sole of the shoe including several fluidly interconnected chambers. The chambers include first chambers disposed in the forefoot area of the sole and second chambers disposed in the heel portion of the sole. In one embodiment, the resilient insert is air inflatable using an on-board inflation mechanism disposed in the sole, wherein the resilient insert remains generally rigid when not inflated.

16 Claims, 4 Drawing Sheets

U.S. PATENT DOCUMENTS 1,869,257 A 7/1932 Hitzler
1,979,972 A 11/1934 Guild
2,007,803 A 7/1935 Kelly
2,020,240 A 11/1935 Cochran
2,074,286 A 3/1937 Sullivan
2,080,469 A 5/1937 Gilbert
2,080,499 A 5/1937 Nathansohn
2,090,881 A 8/1937 Wilson
2,100,492 A 11/1937 Sindler
2,177,116 A 10/1939 Persichino
2,434,770 A 1/1948 Lutey
2,468,886 A 5/1949 Lutey
2,488,382 A 11/1949 Davis
2,600,239 A 6/1952 Gilbert
2,605,560 A 8/1952 Gouabault
2,677,904 A 5/1954 Reed
2,677,906 A 5/1954 Reed
2,682,712 A 7/1954 Owsen et al.
2,762,134 A 9/1956 Town
2,863,230 A 12/1958 Cortina
2,981,010 A 4/1961 Aaskov
3,044,190 A 7/1962 Urbany
3,100,354 A 8/1963 Lombard et al.
3,120,712 A 2/1964 Menken
3,469,576 A 9/1969 Smith et al.
3,608,215 A 9/1971 Fukuoka
3,716,930 A 2/1973 Brahm
3,744,159 A 7/1973 Nishimura
3,795,994 A 3/1974 Ava
3,888,242 A 6/1975 Harris et al.
4,008,530 A 2/1977 Gager
4,123,855 A 11/1978 Thedford
4,129,951 A 12/1978 Petrosky
4,183,156 A 1/1980 Rudy
4,211,236 A 7/1980 Krinsky
4,217,705 A 8/1980 Donzis
4,219,945 A 9/1980 Rudy
4,263,728 A 4/1981 Frecentese
4,271,606 A 6/1981 Rudy
4,297,797 A 11/1981 Meyers
4,312,140 A 1/1982 Reber
4,340,626 A 7/1982 Rudy
4,342,157 A 8/1982 Gilbert
4,358,902 A * 11/1982 Cole et al. ..... 36/28
4,397,104 A 8/1983 Doak
4,446,634 A 5/1984 Johnson et al.
4,458,430 A 7/1984 Peterson
4,462,171 A 7/1984 Whispell
4,471,538 A 9/1984 Pomeranz et al.
4,486,964 A 12/1984 Rudy
4,536,974 A 8/1985 Cohen
4,546,556 A 10/1985 Stubblefield
4,547,978 A 10/1985 Radford
4,571,853 A 2/1986 Medrano
4,577,417 A 3/1986 Cole
4,593,482 A 6/1986 Mayer
4,610,099 A 9/1986 Signori
4,611,412 A 9/1986 Cohen
4,662,087 A 5/1987 Beuch
4,670,995 A 6/1987 Huang
4,702,022 A 10/1987 Porcher
4,744,157 A 5/1988 Dubner
4,763,426 A 8/1988 Polus et al.
4,768,295 A 9/1988 Ito
4,779,359 A 10/1988 Famolare, Jr.
4,799,319 A 1/1989 Zellweger
4,817,304 A 4/1989 Parker et al.
4,833,795 A 5/1989 Diaz
4,845,861 A 7/1989 Moumdjian
4,852,274 A 8/1989 Wilson
4,856,208 A 8/1989 Zaccaro
4,874,640 A 10/1989 Donzis
4,887,367 A 12/1989 Mackness et al.
4,906,502 A 3/1990 Rudy
4,912,861 A 4/1990 Huang
4,918,838 A 4/1990 Chang
4,936,030 A 6/1990 Rennex
4,991,317 A 2/1991 Lakic
4,995,173 A 2/1991 Spier
4,999,931 A 3/1991 Vermeulen
5,005,300 A 4/1991 Diaz et al.
5,005,575 A 4/1991 Geri
5,014,449 A 5/1991 Richard et al.
5,022,109 A 6/1991 Pekar
5,025,575 A * 6/1991 Lakic ..... 36/44
5,042,176 A 8/1991 Rudy
5,113,599 A 5/1992 Cohen et al.
5,131,174 A 7/1992 Drew et al.
5,155,927 A 10/1992 Bates et al.
5,179,792 A 1/1993 Brantingham
5,195,257 A 3/1993 Holcomb et al.
5,228,156 A 7/1993 Wang
5,230,249 A 7/1993 Sasaki et al.
5,235,715 A 8/1993 Donzis
5,253,435 A 10/1993 Auger et al.
5,255,451 A 10/1993 Tong et al.
5,295,314 A 3/1994 Moumdjian
5,311,674 A 5/1994 Santiyanont et al.
5,313,717 A 5/1994 Allen et al.
5,335,382 A 8/1994 Huang
5,353,459 A 10/1994 Potter et al.
5,363,570 A 11/1994 Allen et al.
5,367,792 A 11/1994 Richard et al.
5,375,346 A 12/1994 Cole et al.
5,381,607 A 1/1995 Sussmann
5,392,534 A 2/1995 Grim
5,395,674 A 3/1995 Schmidt et al.
5,406,719 A 4/1995 Potter
5,416,986 A 5/1995 Cole et al.
5,443,529 A 8/1995 Phillips
5,545,463 A 8/1996 Schmidt et al.
5,564,143 A 10/1996 Pekar et al.
5,572,804 A 11/1996 Skaja et al.
5,607,749 A 3/1997 Strumor
5,625,964 A 5/1997 Lyden et al.
5,625,965 A 5/1997 Bissett et al.
5,664,341 A 9/1997 Schmidt et al.
5,679,439 A 10/1997 Schmidt et al.
5,701,687 A 12/1997 Schmidt et al.
5,706,589 A 1/1998 Marc
5,741,568 A 4/1998 Rudy
5,755,001 A 5/1998 Potter et al.
5,771,606 A * 6/1998 Litchfield et al. ..... 36/29
5,784,807 A 7/1998 Pagel
5,794,361 A 8/1998 Sadler
5,802,739 A 9/1998 Potter et al.
5,806,208 A 9/1998 French
5,832,630 A 11/1998 Potter
5,839,209 A 11/1998 Healy et al.
6,009,637 A * 1/2000 Pavone ..... 36/29
6,354,020 B1 * 3/2002 Kimball et al. ..... 36/29
6,510,624 B1 * 1/2003 Lakic ..... 36/29
2001/0045026 A1 * 11/2001 Huang ..... 36/29

FOREIGN PATENT DOCUMENTS

CA 1143938 4/1983
CA 1230225 12/1987
DE 820 869 11/1951
DE 28 00 359 7/1979
DE 32 45 182 5/1983
EP 0 095 357 11/1983
EP 0 301 331 2/1989
EP 0 629 360 12/1994

| | | |
|---|---|---|
| EP | 0 630 592 | 12/1994 |
| EP | 0 714 613 | 6/1996 |
| FR | 720257 | 2/1932 |
| FR | 2452889 | 10/1980 |
| FR | 2614510 | 11/1988 |
| FR | 2663208 | 12/1991 |
| GB | 14955 | 0/1894 |
| GB | 338266 | 11/1930 |
| GB | 520514 | 4/1940 |
| GB | 817521 | 6/1959 |
| GB | 2085278 | 4/1982 |
| GB | 2114425 | 8/1983 |
| GB | 2165439 | 4/1986 |
| GB | 2201082 | 8/1988 |
| JP | 6-181802 | 7/1994 |
| WO | WO 87/03789 | 7/1987 |
| WO | WO 89/06500 | 7/1989 |
| WO | WO 89/10074 | 11/1989 |
| WO | WO 91/11931 | 8/1991 |
| WO | WO 91/16831 | 11/1991 |
| WO | WO 91/18527 | 12/1991 |
| WO | WO 93/12685 | 7/1993 |
| WO | WO 93/14659 | 8/1993 |
| WO | WO 95/20332 | 8/1995 |
| WO | WO 98/09546 | 3/1998 |
| WO | WO 01/19211 | 3/2001 |

OTHER PUBLICATIONS

Runner's World, pp. 58-59, 69 and 74 (Apr. 1991).

Brochure of the Nike Air Force 180 shoe, included with photographs of shoes on sale prior to Nov. 1993.

* cited by examiner

INSERT WITH VARIABLE CUSHIONING AND SUPPORT AND ARTICLE OF FOOTWEAR CONTAINING SAME

This application claims priority to Provisional Application No. 60/547,536, which is incorporated herein by reference in its entirety.

BACKGROUND OF THE INVENTION

1. Field of the Invention

The field of this invention generally relates to footwear, and more particularly to an article of footwear having a system for providing cushioning and support for the comfort of the wearer.

2. Background Art

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, during a typical walking or running stride, the achilles tendon and the arch stretch and contract, storing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain.

Proper footwear should complement the natural functionality of the foot, in part by incorporating a sole (typically, an outsole, midsole and insole) which absorbs shocks. However, the sole should also possess enough resiliency to prevent the sole from being "mushy" or "collapsing," thereby unduly draining the energy of the wearer.

In light of the above, numerous attempts have been made over the years to incorporate into a shoe means for providing improved cushioning and resiliency to the shoe. These attempts have included using compounds such as ethylene vinyl acetate (EVA) or polyurethane (PU) to form midsoles. However, foams such as EVA tend to either break down over time or do not provide adequate cushioning characteristics.

One concept practiced in the footwear industry to improve cushioning and energy return has been the use of fluid-filled devices within shoes. For example, U.S. Pat. Nos. 5,771,606, 6,354,020 and 6,505,420 teach such devices. These devices attempt to enhance cushioning and energy return by transferring a fluid between the area of impact and another area of the device. The basic concept of these devices is to have cushions containing fluid disposed adjacent the heel or forefoot areas of a shoe which transfer fluid to the other of the heel or forefoot areas. Several overriding problems exist with these devices.

One of these problems is that often fluid filled devices are not adjustable. Physiological variances between people and the variety of activities for which athletic shoes may be worn create the need for adjustment in support. For example, shoes can be made to adjust for the various lengths of feet, but it is impossible for the shoe industry to account for variations in the weight of the wearer. In addition, the same appropriate balance of support and cushioning could change for various activities such as running, biking, or casual walking. Also, athletes, both professional and amateur, may desire different support for different performance levels. For example, an athlete may desire a different support while training than while competing. Consequently, it is desirable to adjust the amount of pressure within the sole.

It has been known to adjust fluids in the sole of footwear. For example, U.S. Pat. No. 4,610,099 to Signori (the Signori patent) shows a shoe having an inflatable bladder in the sole. The Signori patent provides for the bladder to be inflated using a hypodermic needle insertion. While the device shown by the Signori patent allows a user to customize his or her shoe, the off-board inflation mechanism makes it difficult to inflate the bladder on an as needed basis. Unfortunately, the solution is not to simply slap an on-board inflation mechanism to the shoe. To do so creates extraordinary construction problems. Further, the Signori patent does not address how a custom underfoot system would be adapted for performance in the forefoot. Similar devices are disclosed by U.S. Pat. No. 3,120,712 to Menken and U.S. Pat. No. 1,069,001 to Guy.

Another problem with these support systems is the constant need for inflation. When the system is not inflated and the air pressure is at ambient conditions, the system typically provides no support to the foot. Instead, either the system becomes flat such that the foot will feel the shock from the impact of each step or the bladder will become mushy draining the energy of the wearer.

What is desired is a system whereby variable support under the foot is achieved with a conveniently located on-board inflation mechanism, wherein such a support system uses the common anatomical features of the motion of the foot and is resilient enough to support even when not inflated.

BRIEF SUMMARY OF THE INVENTION

In accordance with the purpose of the present invention as embodied and described herein, the present invention is a support and cushioning system disposed within the sole of an article of footwear. The system of the present invention includes a resilient insert disposed within the sole of the footwear.

In one embodiment, a resilient insert has at least one chamber and an inflation mechanism. The inflation mechanism allows the wearer to adjust the pressure of a fluid in the resilient insert. Other embodiments incorporate a deflation mechanism or a pressure gauge to further control the cushioning and support provided by the resilient insert.

In another embodiment, a resilient insert includes a plurality of first chambers and a plurality of second chambers each aligned along the length of the shoe which are fluidly connected to at least the directly adjacent chamber. The plurality of first chambers are disposed in the forefoot area of the sole and the plurality of second chambers are disposed in the heel area of the sole. Thus, pressure applied to one of said chambers causes an increase in pressure in that chamber and forces the air into one or more adjacent chambers. The initial increased pressure provides shock absorbing cushioning at the pressure site while the rush of fluid from the chamber provides support for the wearer at the adjacent chambers. Thus, the system of the present invention provides a variable, non-static cushioning, in that the flow of air within the resilient insert complements the natural biodynamics of an individual's gait.

A resilient insert described in the paragraph above may include fluid at ambient pressure or pressurized above ambient pressure. However, in a preferred embodiment, the resilient insert is inflatable to a variety of pressures. However, the rigidity of the resilient insert provides support even when the resilient insert is not inflated.

An inflatable resilient insert allows for the adjustment of the level of support the foot receives based on the wearer's individual needs. The level of support can be adjusted based on the type of activity, i.e. running, biking or casual walking, on the performance level desired, i.e. recreational, training, or competitive, or on other individual needs, such as the variance in weight of the wearer.

An inflatable embodiment includes an inflation mechanism. Various inflation mechanisms could be used, including an on-board and detachable inflation mechanism. On-board inflation mechanisms can be located in various places on the shoe. A preferred embodiment has an inflation mechanism disposed within the sole of the shoe. Having the inflation mechanism disposed in the sole streamlines the manufacture of the shoe and reduces the amount of tubing and other material needed to connect the pump to the resilient insert disposed in the sole of the shoe. In addition, one embodiment includes a means for limiting the swelling of one or more chambers of resilient insert due to over inflation.

In one embodiment, air is allowed to diffuse out of the system over time. However, in a preferred embodiment, a release valve is included. A release valve allows the wearer to have immediate adjustability with respect to either the increase or decrease in pressure.

In one embodiment, the resilient insert is used in conjunction with an sole plate and an outsole. In this embodiment, the sole plate comprises a plurality of holes that correspond to the shape of the chambers of the resilient insert. The resilient insert is then received by the sole plate such that the chambers extend through the holes towards the outsole. In a preferred embodiment, no conventional midsole material is utilized. The outsole includes two or more outsole units with at least one outsole unit disposed towards the forefoot of the sole and at least on outsole unit disposed towards the heel of the sole.

The present invention also includes a sole including the resilient insert of the present invention and an article of footwear including the resilient insert of the present invention.

BRIEF DESCRIPTION OF THE DRAWINGS/FIGURES

DETAILED DESCRIPTION OF THE INVENTION

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other devices and applications.

Figure 1:
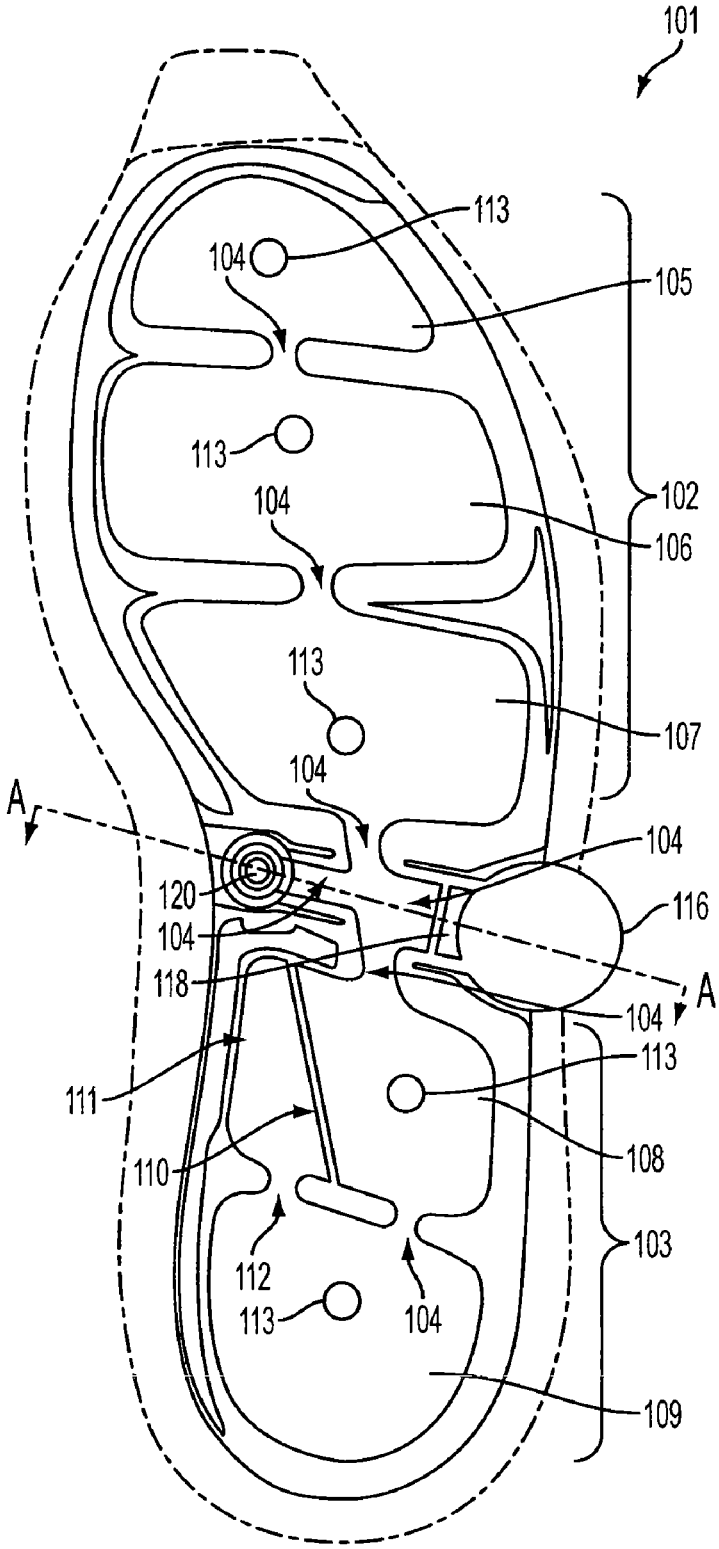
FIG. 1 is a bottom view of an embodiment of a resilient insert in accordance with the present invention.

Referring to FIGS. 1-4, a resilient insert 101 is shown. Resilient insert 101 provides dynamic cushioning to an article of footwear, such that the wearer's stride forces air within resilient insert 101 to move in a complementary manner with respect to the stride. FIG. 1 is a bottom plan view a preferred embodiment of the present invention.

Resilient insert 101 is a three-dimensional structure formed of suitable rigid material so as to allow resilient insert 101 to compress and expand while resisting breakdown and providing support with or without the addition of a fluid to the resilient insert. Preferably, resilient insert 101 may be formed from a thermoplastic elastomer or a thermoplastic olefin. Suitable materials used to form resilient insert 101 may include various ranges of the following physical properties:

| | Preferred Lower Limit | Preferred Upper Limit |
|---|---|---|
| Density (Specific Gravity in g/cm3) | 0.80 | 1.35 |
| Modulus @ 300% Elongation (psi) | 1,000 | 6,500 |
| Permanent Set @ 200% Strain (%) | 0 | 55 |
| Compression Set 22 hr/23 □ C | 0 | 45 |
| Hardness Shore A | 70 | 0 |
| Shore D | — | 55 |
| Tear Strength (KN/m) | 60 | 600 |
| Permanent Set at Break (%) | 0 | 600 |

Many materials within the class of Thermoplastic Elastomers (TPEs) or Thermoplastic Olefins (TPOs) can be utilized to provide the above physical characteristics. Thermoplastic Vulcanates (such as SARLINK from PSM, SANTAPRENE from Monsanto and KRATON from Shell) are possible materials due to physical characteristics, processing and price. Further, Thermoplastic Urethanes (TPU's), including a TPU available from Dow Chemical Company under the tradename PELLETHANE (Stock No. 2355-95AE), a TPU available from B.F. Goodrich under the tradename ESTANE and a TPU available from BASF under the tradename ELASTOLLAN provide the physical characteristics described above. Additionally, resilient insert 101 can be formed from natural rubber compounds. However, these natural rubber compounds currently cannot be blow molded as described below.

The preferred method of manufacturing resilient insert 101 is via injection molding. It will be appreciated by those skilled in the art that the injection molding process is relatively simple and inexpensive. Further, each element of resilient insert 101 of the present invention is created during the same preferred molding process. This results in a unitary, "one-piece" resilient insert 101, wherein all the unique elements of resilient insert 101 discussed herein are accomplished using the same mold. An injection molded resilient article can have other features RF (radio frequency) welded, heat welded, or ultrasonic welded. Further, other manufacturing methods can be used to form resilient insert 101, such as thermoforming and sealing, or vacuum forming and sealing, two pieces together.

As an alternative, a unitary, "one-piece" component can also be created by any one of the following extrusion blow molding techniques: needle or pin blow molding with subsequent sealing, air entrapped blow molding, pillow blow molding or frame blow molding. These blow molding techniques are known to those skilled in the relevant art. Alternatively, other types of blow molding, such as injection blow molding and stretch blow molding may be used to form resilient insert 101. Other methods and material that are apparent to one skilled in the art are also suitable for the resilient insert of the present invention.

As can be seen in FIG. 1, a resilient insert 101 may comprise a plurality of first chambers 102 set in the forefoot portion of the resilient insert and a plurality of second chambers 103 set in the heel portion of the resilient insert. Each chamber is fluidly connected to its adjacent chambers via fluid connections 104. The resilient insert of the embodiment of FIG. 1 shows the plurality of first and second chambers 102, 103 generally aligned along the longitudinal length of the resilient insert in series. Resilient insert 101 has an overall shape that corresponds to the outline of a human foot being widest at the forefoot and narrower at the toe, arch and heel. The width of each of the plurality of first and second chambers 102, 103 generally covers the entire width of this shape.

In FIG. 1, the plurality of first chambers 102 is divided into a first forefoot chamber 105, a second forefoot chamber 106 and a third forefoot chamber 107. Similarly, the plurality of second chambers 103 is divided into a first heel chamber 108 and a second heel chamber 109. Preferably, the first heel chamber 108 is divided by the presence of an optional wall barrier 110 to create optional third heel chamber 111 on the medial side of first heel chamber 108. The optional wall barrier 110 can be formed as a weld line along with the rest of the resilient insert or, as an alternative, by RF welding, heat welding or ultrasonic welding the resilient insert. Optional third heel chamber 111 is fluidly connected to second heel chamber 109 via an optional fluid connector 112. Thus, the first heel chamber 108, the second heel chamber 109, and the optional third heel chamber 111 are fluidly interconnected in series.

As seen in the preferred embodiment of FIG. 1, the first forefoot chamber 105 and the second heel chamber 109 are generally semi-circle shaped, while the remainder of the chambers are generally a rounded rectangular shape, taking up nearly the entire width of the resilient insert 101.

Figure 2:
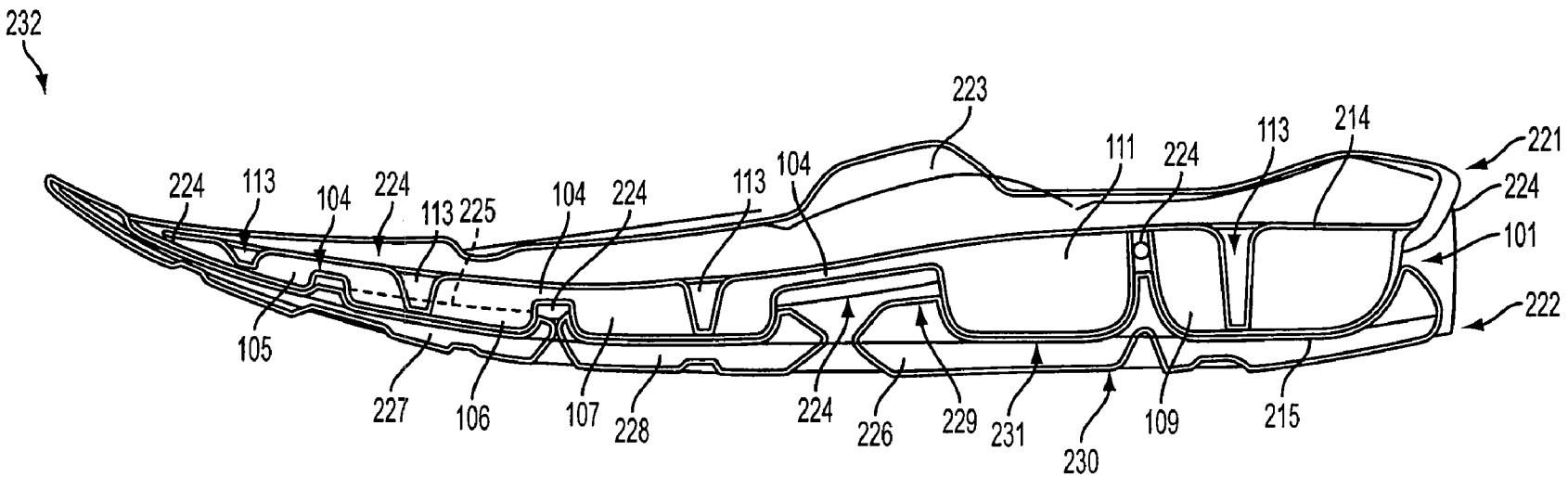
FIG. 2 is a medial side longitudinal cross sectional view of an embodiment of a sole of the present invention comprising the resilient insert of FIG. 1.

In the course of a typical gait, the lateral portion of the heel is the first area to strike the resilient insert 101. This first strike causes the largest downward force of pressure throughout the entire gait. FIG. 2 is a medial side view of the sole 232 comprising the resilient insert 101 of FIG. 1. As seen in FIG. 2, it is preferred that the plurality of second chambers 103 be formed to be significantly vertically thicker than the plurality of first chambers 102. Thus the plurality of second chambers 103 comprises a larger volume and ultimately holds more air than the plurality of first chambers 102.

As the first heel strike occurs, the air that exists in the second heel chamber 109 provides a cushion for the heel to absorb the shock from the impact of that downward pressure. As pressure continues downward, the second heel chamber 109 somewhat collapses causing the air pressure in the second heel chamber 109 to increases with the decrease in volume of that chamber. Consequently, the air is forced out of the second heel chamber 109 into the first heel chamber 108 and the optional third heel chamber 111.

Since the first heel chamber 108 is also fluidly connected to the other chambers via the fluid connection 104 to the third forefoot chamber 107, the air pressure among chambers 105, 106, 107 and 109 is equalized. As the air is forced into these chambers, the chambers swell and develop a slightly convex shape. The additional pressure added to these chambers provides support for the remaining areas of the foot and cushioning as the gait continues.

The pressure from the remainder of the heel rolls onto the first heel chamber 108 and the optional third heel chamber 111, the air is forced out of the first heel chamber 108 and optional third heel chamber 111. As this happens, some of the pressure is taken off of the second heel chamber 109 allowing some of the air from the first heel chamber 108 and the optional third heel chamber 111 to move backwards into the second heel chamber 109. Some of the air in the first heel chamber 108 is also pushed forward into the third forefoot chamber 107 and equalized among forefoot chambers 105, 106 and 107.

Consequently, as the pressure from the foot gradually rolls along the longitudinal length of the resilient insert, the pressure in each chamber is constantly shifted to provide cushioning at the point of pressure and support for the remainder of the foot. Therefore, the air is constantly moving in both directions to compensate for the added pressure in a particular area. When all pressure is removed when the foot is lifted from the first forefoot chamber 105 at "toe-off," the pressure throughout the entire resilient insert 101 is equalized. Upon the next heel strike, the process is repeated.

Alternatively, any of the fluid connections 104 may contain an impedance means (not shown) to prevent air from rushing out of any chamber. An impedance means may be particularly useful between the first heel chamber 108 and the second heel chamber 109. Thus, as the heel strikes, increasing the pressure in the second heel chamber 109, all the air is not forced out of the second heel chamber quickly leaving little to support further impact from the heel.

The shape or structure of the impedance means determines the amount of air that is permitted to pass through the fluid connections 104. In one embodiment, the impedance means comprises a convolution of connecting passages formed by restriction walls. In a simpler embodiment, the impedance means could be a circular or oval shaped structure placed in the middle of the fluid connection 104. Impedance may be caused by forcing the same volume of air to flow in a smaller volume passage, slowing down the movement. The impedance means may be provided by a pinch-off of the material or increased thickness of the walls in the area of the fluid connector 104.

FIG. 2 shows that the resilient insert 101 comprises a top surface 214 and a bottom surface 215. The top surface 214 is generally flat, and the vertical height of the chambers is found in the molded shaping of the bottom surface 215. The fluid connections 104 are also formed by the molded shaping of the bottom surface 215. An alternative embodiment comprises a generally flat bottom surface and has the chambers and fluid connections formed by the molded shaping of the top surface. In yet another embodiment, the resilient insert is formed with both the top and bottom surfaces having a molded shape which forms chambers and fluid connections when seal together.

As air is rushed into a chamber, the top surface 214 and bottom surface 215 of each chamber may swell excessively causing discomfort to the foot or damage to the resilient insert 101. Consequently, a means for limiting the swelling of a chamber may be used. Typically the means involves connecting the top surface 214 to the bottom surface 215 where the most swelling occurs upon being filled with air, i.e., the middle of the chamber.

The swelling may be controlled in a variety of ways. For example, an elastic material may be attached to both the top surface 214 and bottom surface 215 slightly pulling one towards the other. FIG. 2 shows one possible means for limiting swelling 113 of the preferred invention. In this case, a circular point of the top surface 214 is extended through the chamber and adhered to bottom surface 215 of the chamber. The shape of the means for limiting swelling 113 can be circular, as shown in FIG. 1, oval or and other geometric shape. Alternatively, the mean for limiting swelling can be form by a point on the bottom surface 215 extended through the chamber and adhered to the top surface 214 of the chamber. In a further embodiment, a point on both the top and bottom surfaces 214, 215 could be extended through the chamber and meet somewhere between the top and bottom surfaces 214, 215.

The means for limiting swelling 113 may be formed along with the resilient insert in a unitary structure. In this case, it could even be formed as a vertical hole running through the middle of a chamber, having a doughnut hole shape. Additionally, the means for limiting swelling 113 can be formed by RF welding, heat welding, or ultra sonic welding. The means for limiting swelling is also useful to avoid over-inflation of the resilient insert, as discussed below.

The resilient insert shown in FIG. 1 can be filled with air at ambient pressure. Air at ambient pressure will not diffuse out of the resilient insert over time. Alternatively, the air may be pressurized to a pressure greater than ambient pressure. However, over time pressurized air tends to diffuse out of the resilient insert eventually having the pressure restored to ambient conditions. Preferably, the resilient insert is inflatable providing a variety of air pressures within the resilient insert allowing the wearer to adjust the pressure for various conditions or activities. Nonetheless, the resilient insert 101, of FIG. 1, retains its volume even when not inflated, i.e., at ambient pressure. Consequently, the resilient insert 101 provides adequate support for the foot even when not inflated. The thermoformed or injection molded material does not flatten or give a mushy support when the air pressure is equalized.

An inflatable resilient insert requires an inflation mechanism. The inflation mechanism can be an external device which engages the resilient insert through an external connection or valve. Preferably, however, an inflation mechanism is on-board to maintain maximum convenience for the wearer. In other words, the inflation mechanism, is physically attached to the shoe. Often, the inflation mechanism is attached to the upper (often on the tongue or heel of the shoe). Unfortunately, the upper of a shoe and the sole of a shoe are made separately and perhaps even at separate locations. The upper and the sole must then be assembled to form a shoe. Consequently, many on-board inflation mechanisms require complex, expensive and often bulky networks of tubing and valves to connect the inflation mechanism placed inconveniently on the upper of the shoe to the support system in the sole of the shoe. Preferably, however, the inflation mechanism is found on or very near the sole 232 of the shoe to avoid having to connect the inflation mechanism far away from the resilient insert 101.

The preferred embodiment of FIG. 1 shows an inflation mechanism 116. The inflation mechanism 116 is closely adjacent to a one-way valve 118 to keep the air from escaping the resilient insert 101. A variety of different inflation mechanisms can be utilized in the present invention. Preferably, the inflation mechanism is small, lightweight, and provides a sufficient volume of air such that only little effort is needed for adequate inflation. For example, U.S. Pat. No. 5,987,779, which is incorporated by reference, describes an inflation mechanism comprising a bulb (of various shapes) with a check valve. When the bulb is compressed the check valve provides the air within the volume of the bulb be forced into the desired region. As the bulb is released, the check valve allows ambient air to enter the bulb.

Another inflation mechanism, also described in U.S. Pat. No. 5,987,779, is a bulb having a hole in it on top. A finger can be placed over the hole in the bulb upon compression. Therefore, the air, not permitted to escape through the hole, is forced into the desired location. When the finger is removed, ambient air is allowed to enter through the hole. An inflation mechanism having collapsible walls in order to achieve a greater volume of air is preferred. U.S. Pat. No. 6,287,225 describes another type of on-board inflation mechanism suitable for the present invention involving a hidden plunger which moved air into the air bladder of a sports ball. One skilled in the art can appreciate that a variety of inflation mechanisms 116 are suitable for the present invention.

FIG. 1 shows a one-way valve 118 disposed between the inflation mechanism 116 and the chambers. The function of the valve 118 is to avoid air flowing back into the inflation mechanism 116. Various types of one-way valves 118 are suitable for use in the present invention. Preferably, the valve will be relatively small and flat for less bulkiness. U.S. Pat. No. 5,564,143 to Pekar describes a valve suitable for the present invention. The patent describes a valve formed between thermoplastic sheets. One skilled in the art would understand that a variety of suitable valves are contemplated in the present invention.

Figure 4:
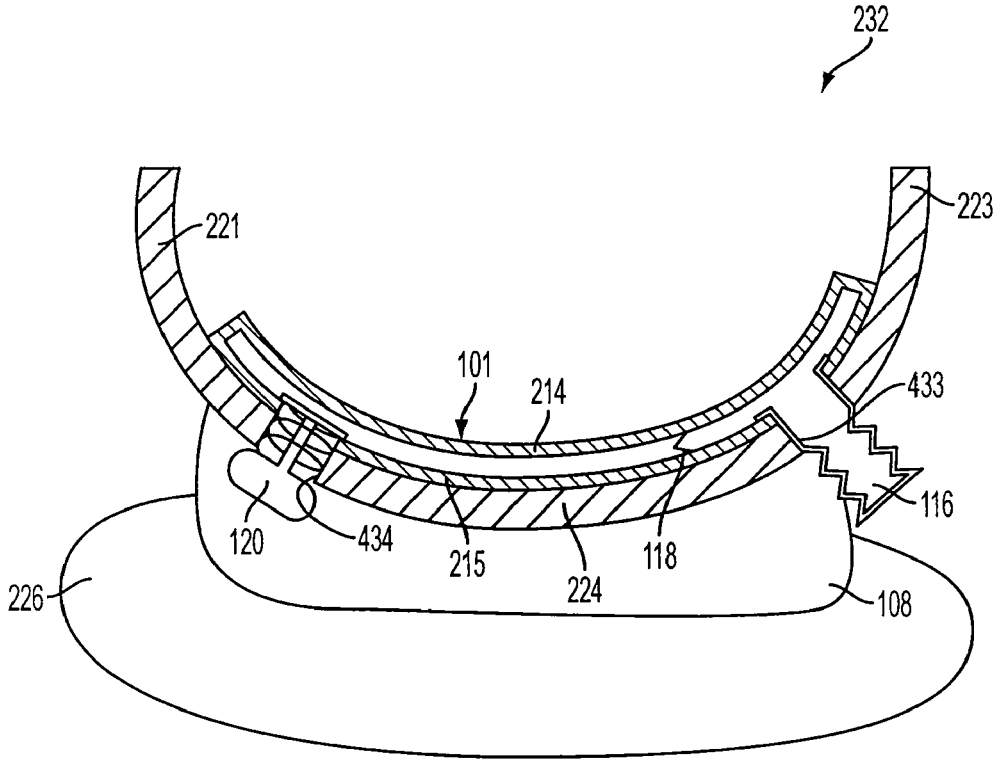
FIG. 4 is a lateral cross sectional view of the sole of FIG. 2 across a line A.

FIG. 1 shows inflation mechanism 116 located on an island disposed independently between the plurality of first chambers 102 and the plurality of second chambers 103. The inflation mechanism is also fluidly connected to both the third forefoot chamber 107 and the first heel chamber 108. In this location, the inflation mechanism 116 can be manufactured concurrently with the resilient insert 101. In addition, the inflation mechanism 116 can be accessible to the wearer from the sole 232 of the shoe. For example, FIG. 4 is a cross section of the sole 232 of the shoe across a line A of FIG. 2 where the inflation mechanism is disposed. FIG. 4 shows how the inflation mechanism 116 may be accessible to the wearer from sole 232 of the shoe. Having the inflation mechanism disposed so closely to the resilient insert 101 also provides less raw material, and therefore, less weight to the shoe.

Figure 3:
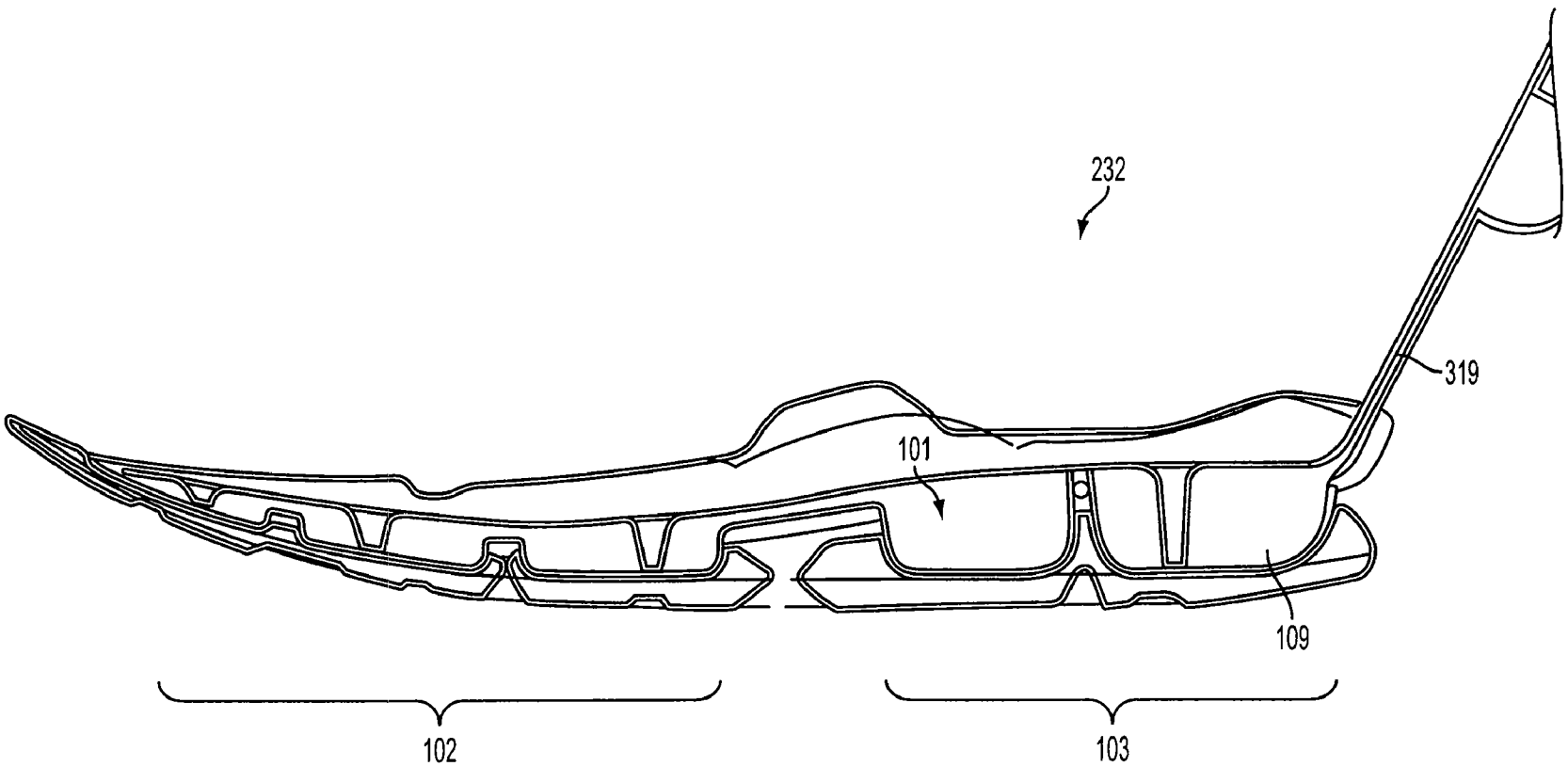
FIG. 3 is a medial side longitudinal cross sectional view of an alternative sole of the present invention comprising an alternative resilient insert.

FIG. 3 is a cross sectional view of another embodiment of the present invention. It shows a generic inflation mechanism 116 fluidly connected to only the second heel chamber 109. Another embodiment may find the inflation mechanism fluidly connected to any of the plurality of first or second chambers 102, 103. FIG. 3 is also an embodiment wherein the inflation mechanism 116 can be manufactured concurrently with the resilient insert 101, but the extra long fluid connection 319 provides that the inflation mechanism can be disposed somewhere other than the sole 232.

In one embodiment, the inflatable resilient insert 101 may be deflated by the natural tendency for pressurized air to diffuse out of the flexible material. However, this system does not provide for immediate adjustment if too much air has been allowed to enter the resilient insert. Consequently, it is preferred that a deflation mechanism, such as deflation mechanism 120 of FIG. 1, be provided fluidly connected to the resilient insert. The deflation mechanism can comprise any type of release valve. One type of release valve is the plunger-type described in U.S. Pat. No. 5,987,779, incorporated herein by reference, wherein air is released upon depression of a plunger which pushes a seal away from the wall of resilient insert 101 allowing air to escape. In particular, a release valve may have a spring which biases a plunger in a closed position. A flange around the periphery of the plunger can keep air from escaping between the plunger and a release fitting because the flange is biased in the closed position and in contact with the release fitting. To release air from resilient insert 101, the plunger is depressed by the user. Air then escapes around the stem of the plunger. This type of release valve is mechanically simple and light weight. The components of a release valve may be made out of a number of different materials including plastic or metal.

As an alternative, deflation valve 120 may also be a check valve, or blow off valve, which will open when the pressure in resilient insert 101 is at or greater than a predetermined level. In each of these situations, resilient insert 101 will not inflate over a certain amount no matter how much a user attempts to inflate the shoe.

One type of check valve has a spring holding a movable seating member against an opening in the bladder. When the pressure from the air inside the bladder causes a greater pressure on the movable seating member in one direction than the spring causes in the other direction, the movable seating member moves away from the opening allowing air to escape the bladder. In addition, any other check valve is appropriate for use in the present invention, as would be apparent to one skilled in the art. For example, the VA-3497 Umbrella Check Valve (Part No. VL1682-104) made of Silicone VL1001M12 commercially available from Vernay Laboratories, Inc. (Yellow Springs, Ohio, USA) may be a preferred check valve.

In another embodiment, deflation valve 120 may be an adjustable check valve, wherein a user can adjust the pressure at which a valve is opened. An adjustable check valve has the added benefit of being set to an individually preferred pressure rather than a factory predetermined pressure. An adjustable check valve may be similar to the spring and movable seating member configuration described in the preceding paragraph. To make it adjustable, however, the valve may have a mechanism for increasing or decreasing the tension in the spring, such that more or less air pressure, respectively, would be required to overcome the force of the spring and move the movable seating member away from the opening in the bladder. However, any type of adjustable check valve is appropriate for use in the present invention, as would be apparent to one skilled in the art, and any adjustable check valve would be appropriate for use in any embodiment of the present invention.

Resilient insert 101 may include more than one type of deflation valve 120. For example, it may include both a check valve and a release valve. Alternatively, resilient insert 101 may contain a deflation valve 120 which is a combination release valve and check valve. This type of valve is described in detail in U.S. Patent Application Publication No. 2004/0003515, which is incorporated herein in its entirety by reference.

FIG. 1 shows deflation mechanism 120 disposed on an island opposite the inflation mechanism 116 between the plurality of first chambers 102 and the plurality of second chambers 103. Similar to the inflation mechanism 116, the deflation mechanism 120 is fluidly connected to both the third forefoot chamber 107 and the first heel chamber 108, thereby providing equal release from the plurality of first chambers 102 and the plurality of second chambers 103. In this location, the wearer can access the deflation mechanism 120 from the sole 232, as seen in FIG. 4. Alternatively, the deflation mechanism can be disposed anywhere on the sole 232 or upper of the shoe and can be fluidly connected to any of the plurality of first or second chambers 102, 103. For example, FIG. 3, shows a deflation mechanism 120 that is fluidly connected to only the second heel chamber 109 and disposed away from the sole 232.

An article of footwear incorporating the present invention will now be described. An article of footwear generally describes an upper and a sole. FIG. 2 shows a sole 232 comprising a resilient insert 101, a sole plate 221 and a plurality of outsole units 222. The sole plate 221 is made of injection molded thermoplastic and is adhered directly to the shoe upper without the use of a midsole material. The sole plate 221 comprises a side portion 223 and a bottom portion 224 connected together along the sides and in back of the sole 232. The bottom portion may have a hinge in the forefoot (not shown) to allow the plate to bend along with the natural tendency of the foot to bend just before the toes, i.e., at the metatarsal heads.

The bottom portion 224 has holes 225 that correspond to the shape of the chambers of the resilient insert 101 formed by the molded shape of the bottom surface 215. The chambers of the resilient insert 101 are received by bottom portion 224 of the sole plate 221 from above, wherein the chambers of the resilient insert 101 extends through the holes 225 of the bottom portion 224 towards the outsole 222. The fluid connectors 104 remain above of the bottom portion 224 of the sole plate 221.

An alternative embodiment may have a midsole with a top surface and a bottom surface, the bottom surface comprising a plurality of concaved indentations that correspond to the top surface of the resilient insert. These indentations are formed to receive the resilient insert. In this embodiment, the top surface of the insert is then adhered to the bottom surface of the midsole. In yet another embodiment, the resilient insert 101 may be disposed within a cavity formed entirely within a midsole.

In addition, holes may be found in the bottom portion 224 or side portion 223 of the sole plate 221 that corresponds to the shape of the inflation mechanism 116 and deflation mechanism 120, respectively. FIG. 4 shows hole 433 exposing the inflation mechanism 116 and hole 434 exposing the deflation mechanism 120, wherein the inflation mechanism 116 and deflating 120 also extend through the sole plate 221. FIG. 4 also shows that portions of the bottom surface 215, such as that in the area of the fluid connectors 104, is permanently adhered to the top surface of the bottom portion 224 of the sole plate 221.

As seen in FIG. 1, the plurality of outsole units 222 comprises a first outsole unit 226 and a second outsole unit 227 and an optional third outsole unit 228. The first outsole unit 226 is disposed in the heel portion of the shoe adjacent to the plurality of second chambers 103. The second outsole unit 227 and the optional third outsole unit 228 are disposed in the forefoot of the shoe adjacent to the plurality of first chambers 102. Each of the plurality of outsole units 222 has an upper surface 229 and a lower surface 230. The upper surface has a plurality of indentations 231 to receive the chambers of the resilient insert 101.

It is advantageous to have a plurality of outsole units because the foot has natural bend at the metatarsal heads. Consequently, the second outsole unit 227 can move independently of the first and optional third outsole units 226, 228. However, the first outsole unit 226 could be extended to cover not only the plurality of second chambers 103 of the resilient insert 101, but also the arch area and the chambers covered by the optional third outsold unit 228 in FIG. 1. However, it is preferred that a sufficient distance exists between the first outsole unit 226 and the optional third outsole unit 228 such that the wearer has access to the inflation mechanism 116 and deflation mechanism 120 that extend through the sole plate 221. In addition, FIG. 4 shows that the first outsole unit 226 has sufficient height such that the inflation mechanism 116 does not come in contact with the ground with each step. Nonetheless, an outsole may be used that extends along the entire longitudinal length of the sole 232.

In the configuration of FIG. 2, the chambers of the resilient insert are visible between the sole plate 221 and the plurality of outsole units 222. In addition, a portion of each of the plurality of outsole units 222 may be cut out such that the chambers of the resilient insert 101 are visible from the bottom of the shoe.

It may be desirable for the wearer to inflate the left and right shoes to different pressures based on particular performance needs. However, it more probable that the wearer would choose to inflate both shoes to the same pressure, thereby getting equal support. Consequently, a pressure gage (not shown) which is also fluidly connected to the resilient insert may be employed to allow the wearer to determine when the resilient insert is inflated to the desired pressure, or a pressure equal to the resilient insert of the other shoe.

Further it will be appreciated by one skilled in the art that the shoe in which resilient insert 101 is incorporated may be constructed so that resilient insert 101 is readily removable. Such a shoe may be utilized without an insert or may be replaced with another resilient insert. The resilient insert 101 may be removable from any location within the sole.

It will also be readily appreciated that the resilient insert may comprise only the forefoot portion (the plurality of first chamber 102) or only the heel portion (the plurality of second chambers 103).

Further it can be appreciated that fluid mediums other than air can provide adequate support and movement in the resilient insert of the present invention, such as liquids and large molecule gases.

The foregoing description of the preferred embodiment, as shown in FIGS. 1, 2 and 4, is presented for purposes of illustration and description. It is not intended to be exhaustive or to limit the invention to the precise form disclosed, and obviously many modifications and variations are possible in light of the above teachings. For example, it is not necessary that the resilient insert 101, especially the plurality of first chambers 102, the plurality of second chambers 103, and the fluid connections 104 be shaped as shown in the Figures. Chambers and fluid connections of other shapes may function equally as well. Further, an inflatable resilient insert 101 may have greater or fewer chambers, even as few as a single chamber disposed in the heel or forefoot area of the shoe.

It is presumed that the preferred embodiment of the resilient insert 101 of the present invention will find its greatest utility in athletic shoes (i.e., those designed for running, walking, hiking, and other athletic activities.) However, the resilient insert may also be useful in other types of shoes.

While the invention has been particularly shown and described with reference to preferred embodiments thereof, it will be understood by those skilled in the art that various changes in form and details may be made therein without departing form the spirit and scope of the invention.

What is claimed is:

1. An article of footwear comprising:

a sole;

an outsole;

an insert disposed within said sole having a plurality of fluidly connected chambers, wherein each of said chambers is defined by a first surface and a second surface, wherein at least one of said surfaces has a molded shape, wherein said insert is inflatable to more than one pressure and wherein said insert retains substantially the same volume at ambient pressure and when inflated to a pressure greater than ambient pressure;

an inflation mechanism fluidly connected to said insert, said inflation mechanism comprising an inlet for ambient air; and a one-way valve between said inflation mechanism and said insert;

wherein said sole further comprises a sole plate including an upper surface and a lower surface and a plurality of holes extending from said upper surface to said lower surface for receiving said chambers;

wherein said insert is positioned adjacent said upper surface of said sole plate, whereby said chambers extend through said holes towards said outsole positioned adjacent said lower surface of said sole plate.

2. The article of footwear of claim 1, wherein said insert includes a plurality of fluidly connected forefoot chambers and a plurality of fluidly connected heel chambers, said plurality of forefoot chambers fluidly connected to said plurality of heel chambers.

3. The article of footwear of claim 2, wherein said plurality of forefoot chambers and said plurality of heel chambers are aligned along the length of said article of footwear in series.

4. The article of footwear of claim 1, wherein a material extends from said first surface to said second surface to limit the swelling of said chambers.

5. The article of footwear of claim 1, wherein said first surface is welded to said second surface to limit the swelling of said chambers.

6. The article of footwear of claim 1, wherein said inflation mechanism is disposed on said sole.

7. The article of footwear of claim 1, wherein said insert includes at least one forefoot chamber and at least one heel chamber and said inflation mechanism is disposed between said forefoot chamber and said heel chamber.

8. The article of footwear of claim 7, wherein said inflation mechanism is fluidly connected to only one of said chambers.

9. The article of footwear of claim 1, further comprising a deflation mechanism fluidly connected to said insert.

10. The article of footwear of claim 9, wherein said deflation mechanism is disposed on said sole.

11. The article of footwear of claim 1, wherein said outsole comprises at least one heel unit and at least one forefoot unit.

12. The article of footwear of claim 1, wherein said outsole comprises an upper and lower surface, said upper surface of said outsole having a plurality of concave indentations therein for receiving said plurality of chambers.

13. The article of footwear of claim 1, wherein said insert is an injection molded, thermoplastic unitary structure.

14. The article of footwear of claim 1, wherein said insert is formed by injection molding a thermoplastic material and RF welding at least a portion of said insert.

15. The article of footwear of claim 1, wherein said insert is removable.

16. The article of footwear of claim 1, wherein said insert is visible from an exterior of said sole.

* * * * *